United States Patent [19]

Kikumoto

[11] Patent Number: 4,478,124

[45] Date of Patent: Oct. 23, 1984

[54] SOUND ASPECT GENERATING APPARATUS FOR AN ELECTRONIC MUSICAL INSTRUMENT

[75] Inventor: Tadao Kikumoto, Osaka, Japan

[73] Assignee: Roland Corporation, Osaka, Japan

[21] Appl. No.: 478,735

[22] Filed: Mar. 25, 1983

[30] Foreign Application Priority Data

Jul. 27, 1982 [JP] Japan ..... 57-131805

[51] Int. Cl.[3] ..... G10H 7/00

[52] U.S. Cl. ..... 84/1.19; 84/1.22; 84/1.24

[58] Field of Search ..... 84/1.01, 1.11–1.13, 84/1.19–1.27

[56] References Cited

U.S. PATENT DOCUMENTS

| | | | |
|---|---|---|---|
| 3,886,836 | 6/1975 | Hiyoshi | 84/1.19 X |
| 4,135,424 | 1/1979 | Okamoto | 84/1.13 |
| 4,154,133 | 5/1979 | Kitawaga | 84/1.26 |
| 4,205,575 | 6/1980 | Hoskinson et al. | 84/1.01 |
| 4,291,604 | 9/1981 | Scott et al. | 84/1.19 |

*Primary Examiner*—S. J. Witkowski

*Attorney, Agent, or Firm*—W. G. Fasse; D. H. Kane, Jr.

[57] ABSTRACT

A sound aspect generating apparatus for an electronic musical instrument is adapted to interpolate between respective parameters constituting two kinds of designated sound aspects to generate sound aspects based on the interpolated parameters. More specifically, preset switches (71 to 7*n*) are operated to read out the parameters of the two kinds of sound aspects stored in advance in a memory (50). By designating an arbitrary point between two kinds of sound aspects with the aid of a controller (10), the rate of change of the respective parameters between the designated sound aspects is evaluated by means of a central processing unit (40) and the parameters interpolating the portion between the designated two points are evaluated by the central processing unit based on the above mentioned rate of change. The evaluated parameters are converted into an analog signal which is applied to a music synthesizer as sound aspects, whereby a musical tone signal is produced.

6 Claims, 25 Drawing Figures

SOUND ASPECT GENERATING APPARATUS FOR AN ELECTRONIC MUSICAL INSTRUMENT

BACKGROUND OF THE INVENTION

1. Field of the Invention

The present invention relates to a sound aspect generating apparatus for an electronic musical instrument. More specifically, the present invention relates to an improvement in a sound aspect generating apparatus for an electronic musical instrument adapted for generating a musical tone signal by reading sound aspects such as a tone color, pitch, loudness and the like stored in advance in a memory.

2. Description of the Prior Art

Generally, a sound aspect generating circuit for an electronic musical instrument has been implemented using a voltage controlled oscillator, a filter and the like, whereby a tone is produced based on the parameters constituting the sound aspects such as tone color, pitch, loudness and the like. In playing such an electronic musical instrument, adjustment of a tone, pitch, loudness and the like by a player to produce a desired tone requires time for setting such sound aspects which concentrate less on his performance. Therefore, one might think of storing the sound aspects in advance stored in a memory whereby various kinds of sound aspects are stored in advance and suitably generated during a performance so as to be in accord with the music being performed.

However, when the sound aspects are stored in a memory and the performance takes place thereafter using these stored sound aspects, there is a restriction in the variations of an actually performed tone because the variations of the sound aspects as stored have been determined. More specifically, such approach made it impossible to change the tone variations in accordance with a performance preferance.

SUMMARY OF THE INVENTION

Accordingly, a principal object of the present invention is to provide a sound aspect generating apparatus for an electronic musical instrument adapted for setting at least two kinds of sound aspects and for generating a sound aspect interpolating the portion between the two sound aspects.

Another object of the present invention is to provide a sound aspect generating apparatus for an electronic musical instrument capable of changing so far set sound aspects to a new sound aspect within a relatively short period of time and with little effort by a performer.

A further object of the present invention is to provide a sound aspect generating apparatus for an electronic musical instrument capable of producing a musical tone accompanied by a complicated and natural change as a result of controlling as many parameters as possible constituting the sound aspects.

A still further object of the present invention is to provide a sound aspect generating apparatus for an electronic musical instrument capable of achieving a change of parameters in association with the pitch in a natural musical instrument such as a piano.

According to the present invention a plurality of parameters constituting at least two kinds of sound aspects are set, thereby interpolating between the parameters corresponding to at least two designated kinds of sound aspects when at least two kinds of the sound aspects represented by such parameters are designated, and a sound aspect corresponding to the interpolated parameters is produced.

According to the present invention, by designating at least two kinds of sound aspects, a performance tone, accompanied by a tone of a variation subtly changing in accordance with the preference of a performer, which could not be attained heretofore with a conventional electronic musical instrument, can be produced based on a sound aspect interpolating the portion between the two sound aspects. More specifically, for example by designating an arbitrary musical tone among a piano musical tone, and a harpsichord musical tone, a musical tone may be performed accompanied by a subtle change, not so far available, which interpolates the portion between musical tones.

In a preferred embodiment of the present invention, a plurality of parameters constituting a first musical tone and a second musical tone each having at least two kinds of sound aspects are set, and an interpolation is performed between the parameter corresponding to the first musical tone and the second musical tone when two corresponding sound aspects constituting each of the first musical tone and the second musical tone are designated, whereupon a performance tone corresponding to the interpolated parameters can be produced.

Accordingly, a performance tone interpolating between a piano musical tone and a harpsichord musical tone, for example, can be produced.

These objects and other objects, features, aspects and advantages of the present invention will become more apparent from the following detailed description of the present invention when taken in conjunction with the accompanying drawings.

BRIEF DESCRIPTION OF THE DRAWINGS

FIGS. 4 to 6 are flow diagrams for explaining a specific operation of the embodiment of the present invention, wherein FIG. 4 shows a main routine, FIG. 5 shows an evaluation or calculation subroutine, and FIG. 6 shows a reproduction subroutine;

FIGS. 11 to 15 are flow diagrams for depicting a specific operation of the embodiment of FIG. 8 of the present invention, wherein FIG. 11 is a flow diagram showing an operation procedure, FIG. 12 shows a main routine, FIG. 13 shows a parameter storing subroutine, FIG. 14 shows an evaluation or calculating subroutine, and FIG. 15 shows a reproduction subroutine;

FIGS. 19 to 23 are flow diagrams for depicting an operation of the third embodiment of the present invention, wherein FIG. 19 is a flow diagram showing an operation procedure, FIG. 20 shows a main routine, FIG. 21 shows a parameter storage subroutine, FIG. 22 shows an evaluation or calculation subroutine, and FIG. 23 shows a reproduction subroutine.

DESCRIPTION OF THE PREFERRED EMBODIMENTS AND OF THE BEST MODE OF THE INVENTION

Figure 1:
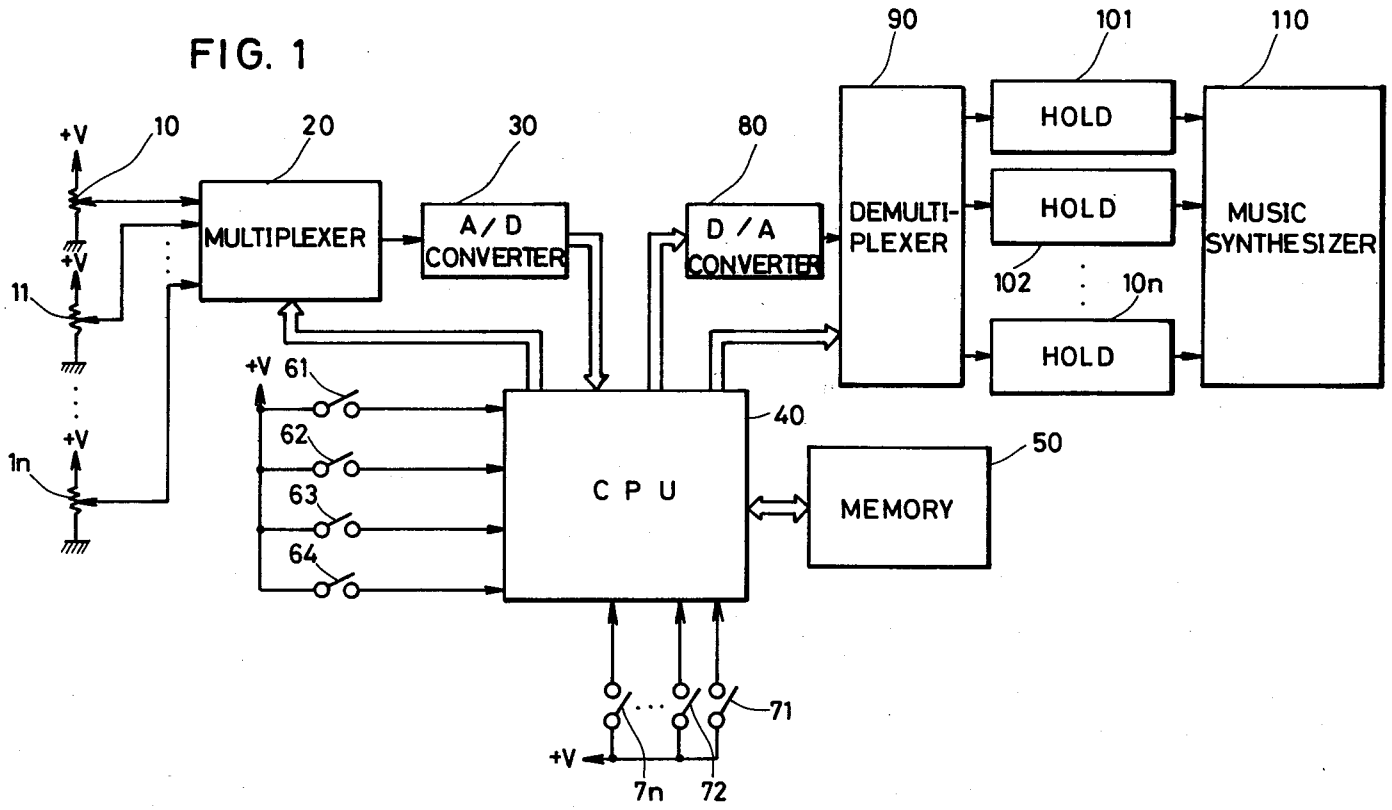
FIG. 1 is a block diagram of one embodiment of the present invention.

FIG. 1 is a block diagram of one embodiment of the present invention including a controller 10 serving as an arbitrary sound aspect designating device in the form of a variable resistor. When the controller 10 is properly operated it provides a voltage value obtained by dividing the voltage +V, to a multiplexer 20. Parameter setting variable resistors 11 to 1*n* serving as a parameter setting devices are used for setting a plurality of parameters constituting a tone color of a sound aspect. A plurality of parameters include an attack time, a decay time, a sustain level, a release time, a waveform of a source tone, a cut-off frequency of a voltage controlled filter resonance, the degree of modulation of a voltage controlled filter, a frequency of a low frequency oscillator, the waveform of the low frequency oscillator, and the like, for example. These parameter setting variable resistors 11 to 1*n* each provide a voltage obtained by dividing the voltage +V, to the multiplexer 20. The multiplexer 20 is responsive to an address signal obtained from a central processing unit 40 to provide in succession in the time sharing fashion the voltage values obtained from the parameter setting variable resistors 11 to 1*n* to an analog/digital converter 30. The analog/digital converter 30 converts the applied voltage value to a digital value, which is applied to the central processing unit 40.

A memory 50 is provided in association with the central processing unit 40. The memory 50 comprises storing regions to be described below with reference to FIGS. 3A and 3B. The central processing unit 40 is connected to a first program switch 61, a second program switch 62, a calculation switch 63, a storing switch 64, and preset switches 71 to 7*n*. The first and second program switches 61 and 62 are used as a sound aspect designating means for designating a tone color at points (C1, C2) set by the controller 10. The calculation switch 63 is used for commanding an evaluation of the ratio of the two points (C1, C2) of the tone color designated by the first and second program switches 61 and 62 and for designating the respective parameters x 11 and x 12, x 21 and x 22, . . . x n1 and n2, i.e. the ratio of change. The storing switch 64 is operated when a parameter corresponding to a tone color having the intended tone colors of two kinds interpolated, is to be stored in the memory 50. The preset switches 71 to 7*n* are used for presetting the sound aspects of musical instruments such as a piano, a harpsichord and the like. A digital/analog converter 80 serves for converting the parameter read as a digital value from the memory 50 by the central processing unit 40 into an analog value and the analog value is applied to a demultiplexer 90 in a time sharing fashion. The demultiplexer 90 is responsive to an address signal obtained from the central processing unit 40 to provide in parallel fashion an analog value of the parameter obtained in a time sharing fashion from the digital/analog converter 80, to hold circuits 101 to 10*n*. To hold circuits 101 to 10*n* may comprise samplehold circuits for maintaining sound aspects of an analog value. The sound aspects held in the hold circuits 101 to 10*n* are fed to a synthesizer 110.

Figure 2:
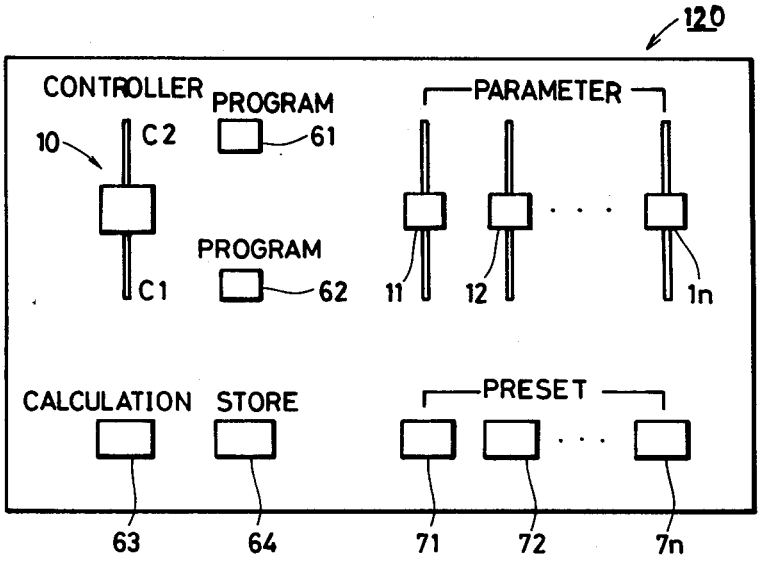
FIG. 2 is a plan view of an operation panel included in one embodiment of the present invention.

FIG. 2 is a front view of a control panel 120 included in one embodiment of the present invention. The control panel 120 comprises the controller 10 and the parameter setting variable resistors 11 to 1*n*, the first and second program switches 61 and 62, the calculation switch 63, the storing switch 64, and the preset switches 71 to 7*n*, respectively, described above in conjunction with FIG. 1.

Figure 3A:
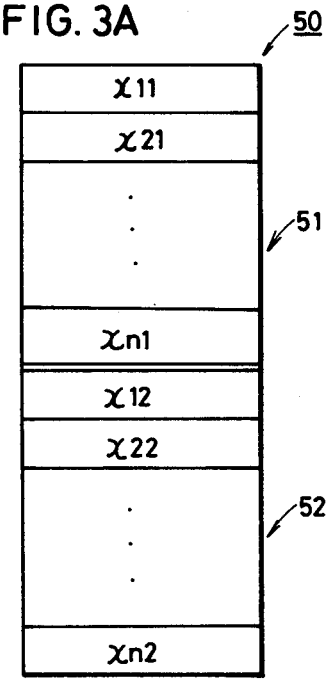
FIGS. 3A and 3B are views showing the data stored in a memory shown in FIG. 1.
Figure 3B:
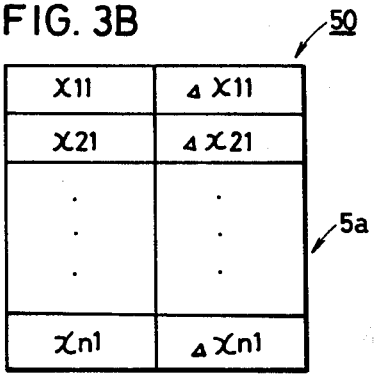
Figure 4:
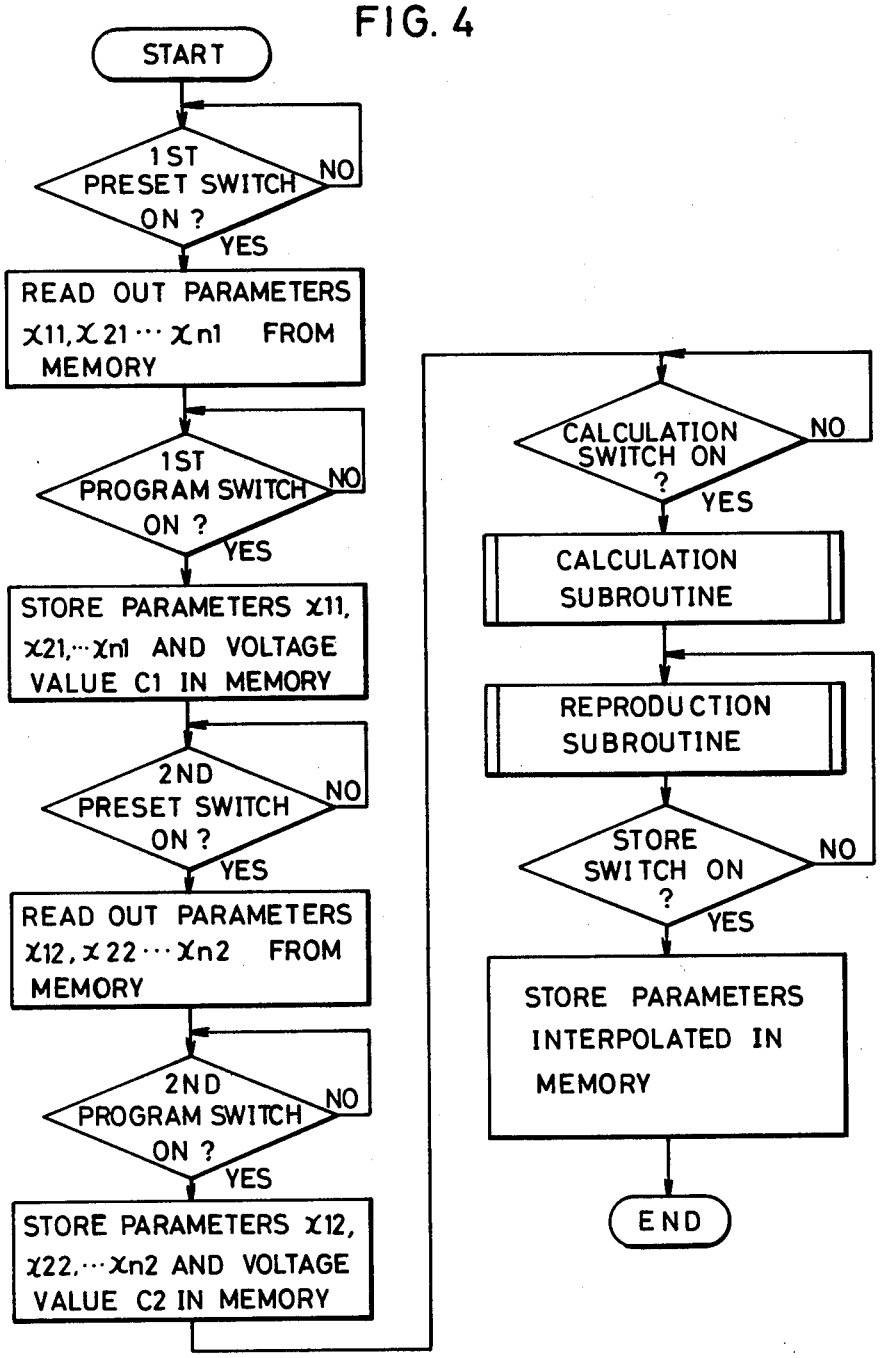
Figure 5:
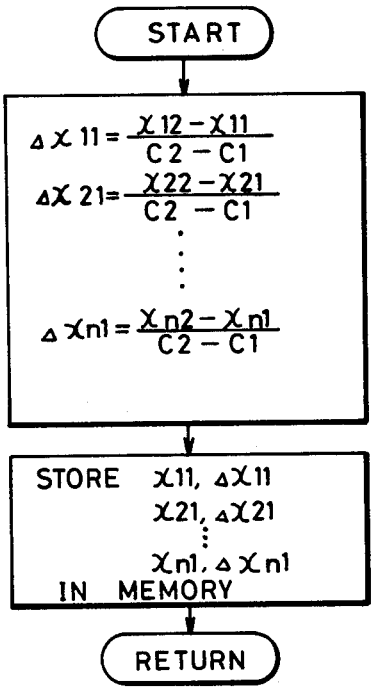

FIGS. 3A and 3B are views showing the data stored in the memory 50 shown in FIG. 1. As shown in FIG. 3A, the memory 50 comprises storing regions 51 and 52 for storing first and second kind parameters of tone colors, and a storing region 5*a* for storing a constant for use in calculating the interpolation, as shown in FIG. 3B. The storing region 51 stores in advance the parameters x 11 to x n1 constituting a tone color of a piano, for example, so that the parameters x11 to xn1 are read out by operating the preset switch 71, for example. Furthermore, the parameters x 12 to x n2 constituting a tone color of a harpsichord, for example, are stored in advance in the storing region 52, so that these parameters x12 to xn2 are read out by operating the preset switch 72, for example. The storing region 5*a* is loaded with the parameters x11 to xn1, and constants Δx11 to Δxn1 for calculation of the parameters to be interpolated.

Now referring to FIGS. 1 to 7, a specific operation of one embodiment of the present invention will be described. In performing a tone of a tone color intermediate of a tone color of a piano and a tone color of a harpsichord, for example, first the preset switch 71 is operated. Accordingly, the central processing unit 40 reads the parameters x11 to xn1 constituting a tone color of a piano, from the storing region 51 corresponding to the preset switch 71. The parameters x11 to xn1 as read are converted by the digital/analog converter 80 into an analog value, whereupon the same is applied through the demultiplexer 90 and the hold circuits 101 to 10*n* to the synthesizer 110. Then a tone determined by the parameters x 11 to x n1 obtained from the synthesizer 110 is performed. Then the first program switch 61 is turned on. At that time, the minimum voltage value C1 that can be set by the controller 10 is applied through the multiplexer 20 to the central processing unit 40 and, therefore, the same is responsive to the operation of the first program switch 61 to temporarily store in the storing region, not shown, of the memory the voltage value C1 set by the controller 10 and the parameters x 11 to x n1 read from the storing region 51.

Figure 7:
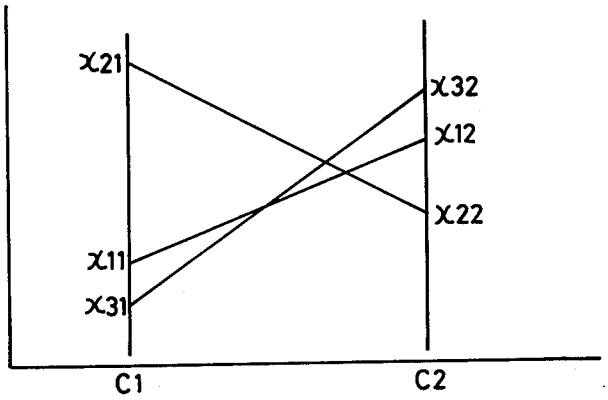
FIG. 7 is a graph depicting an evaluation of the parameters for explaining an interpolation value of the parameters.

When the preset switch 72 for performing a tone of a harpsichord for example, is operated, the parameters x 12 to x n2 obtained from the storing region 52 are read. Then a sound based on these parameters x12 to xn2 is produced by the synthesizer 110. When the second program switch 62 is turned on, the maximum voltage value C2 that can be fed by the controller 10 and the parameters x12 to xn2 read from the memory 52 are temporarily stored in the storing region, not shown, of the memory 50. When the calculation switch 63 is then operated, the central processing unit 40 proceeds to the calculation subroutine shown in FIG. 5. In accordance with the calculation subroutine, the ratio Δx 11 of the difference between the voltage values C1 and C2 and the difference between x11 and x12 when the parameters x11 and x12 are connected by a straight line, as shown in FIG. 7, is evaluated. Likewise, the ratios Δx21 to Δxn1 of the difference between the voltage values C1 and C2 and the difference of the respective parameters are in succession evaluated. Then the parameters x11 to xn1 and the evaluated ratios Δx11 to Δxn1 are temporarily stored in the memory, whereupon the program returns again to the main routine.

Figure 6:
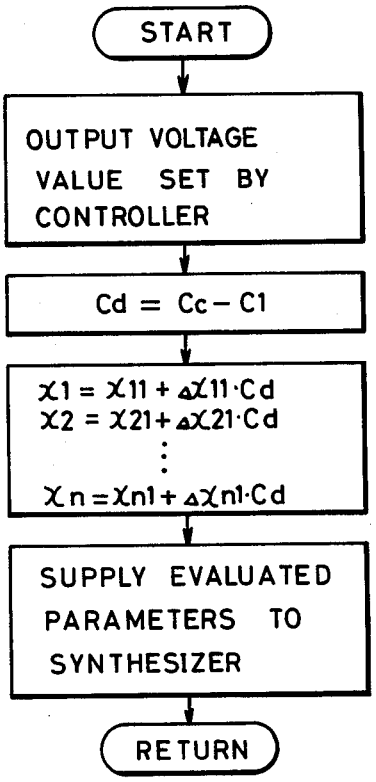

When the program returns to the main routine, then the program proceeds to the reproduction subroutine shown in FIG. 6. More specifically, the controller 10 is operated to produce an intermediate tone of the piano tone color and of the harpsichord tone color, whereby an arbitrary voltage value Cc between the initially set values C1 and C2 is provided. The central processing unit 40 evaluates the difference Cd of the set voltage values Cc and C1. Then the parameters are in succession interpolated. More specifically, the ratio Δx11 temporarily stored in the memory 50 is multiplied by the voltage value Cd which is then added to the parameter x11 and the interpolated parameter x1 is evaluated. Likewise, the ratio Δx21 is multipled by the voltage value Cd which is then added to the parameter x21 and the interpolated parameter x2 is evaluated. Likewise, the interpolated parameters x3 to xn are evaluated. More specifically, the thus interpolated parameters mean the following. If and when the parameter x11 is an attack time of a piano and the parameter x12 is an attack time of a cembalo, the interpolated parameter x1 becomes a value between the attack time of a piano and the attack time of a harpsichord. Furthermore, if and when the parameter x21 is a decay time of a piano and the parameter x22 is a decay time of a harpsichord, then the interpolated parameter x2 is a value between the decay time of a piano and a decay time of the harpsichord. Likewise, the values between the respective parameters of the piano and harpsichord are evaluated. The respective parameters x1 to xn thus interpolated are applied through the digital/analog converter 80, the demultiplexer 90 and the hold circuits 101 to 10*n* to the synthesizer 110. Accordingly, a tone based on the parameter obtained by interpolation of the parameters of a piano and a harpsichord is performed by the synthesizer 110. By operating the storing switch 64 and the preset switch 73 at that time, the parameters x1 to xn thus interpolated are in succession stored in the storing region 53 of the memory 50 corresponding to the preset switch 73.

As described above, according to the embodiment, by presetting the parameters x11 to xn1 of such an attack time and a decay time necessary for producing a tone of a piano, for example, by presetting the parameters x12 to xn2 necessary for producing a tone of a harpsichord by the synthesizer 110 and by setting the arbitrary voltage value Cc by the controller 10, the parameters x1 to xn constituting a tone color having the interpolated tones of a piano and a harpsichord can be evaluated.

Figure 8:
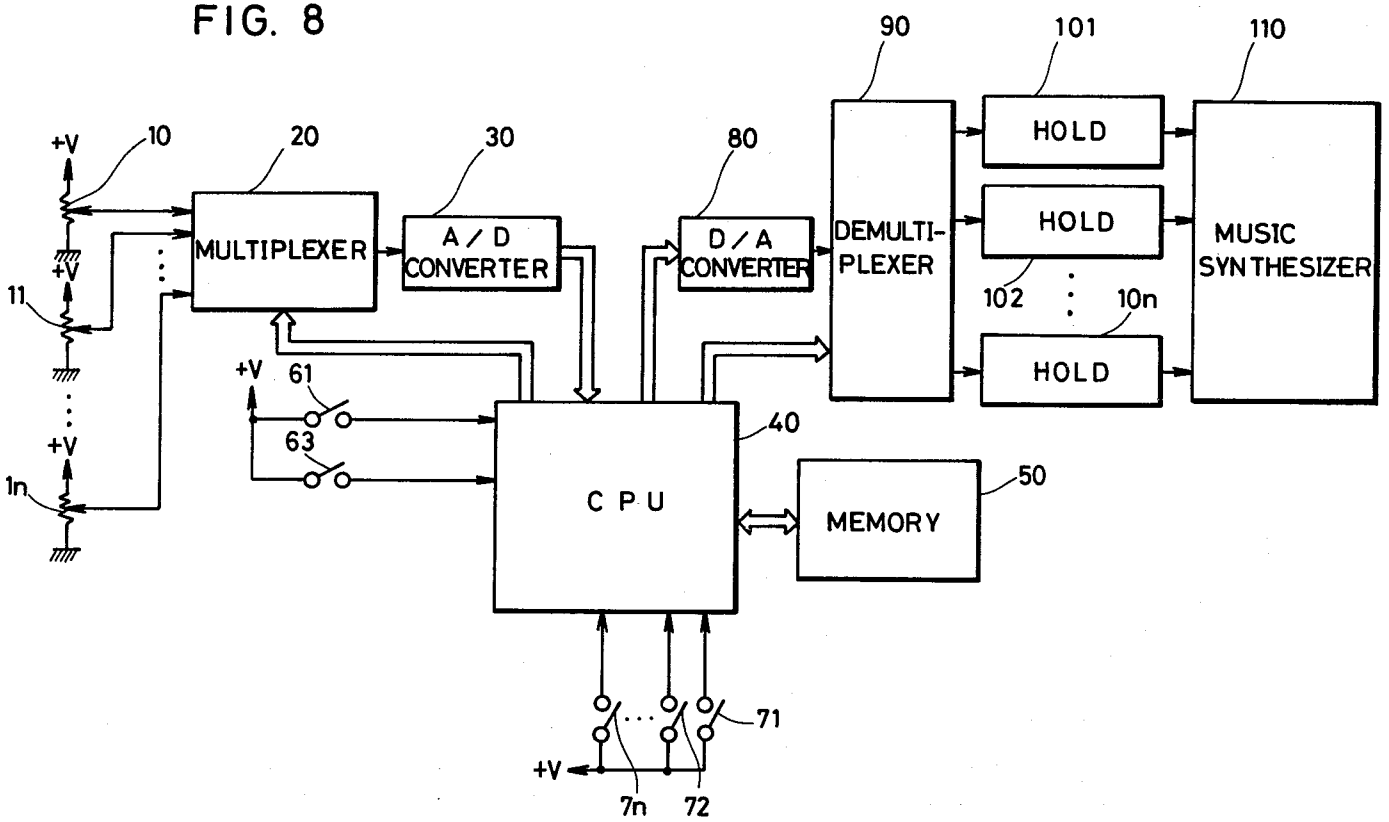
FIG. 8 is a block diagram showing another embodiment of the present invention.
Figure 9A:
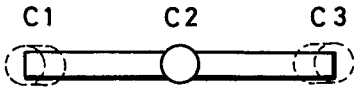
FIGS. 9A and 9B are front views of a controller employed in the embodiment of FIG. 8.
Figure 9B:
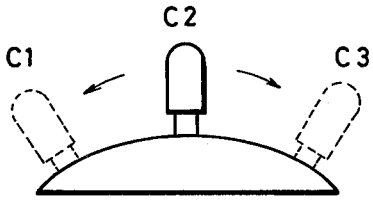
Figure 10:
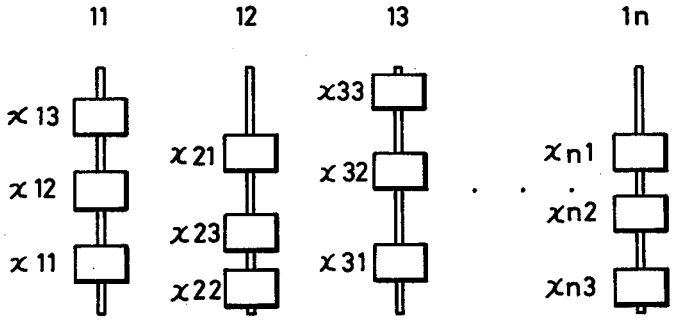
FIG. 10 is a view showing an operational state of parameter setting variable resistors of the embodiment of FIG. 8.
Figure 11:
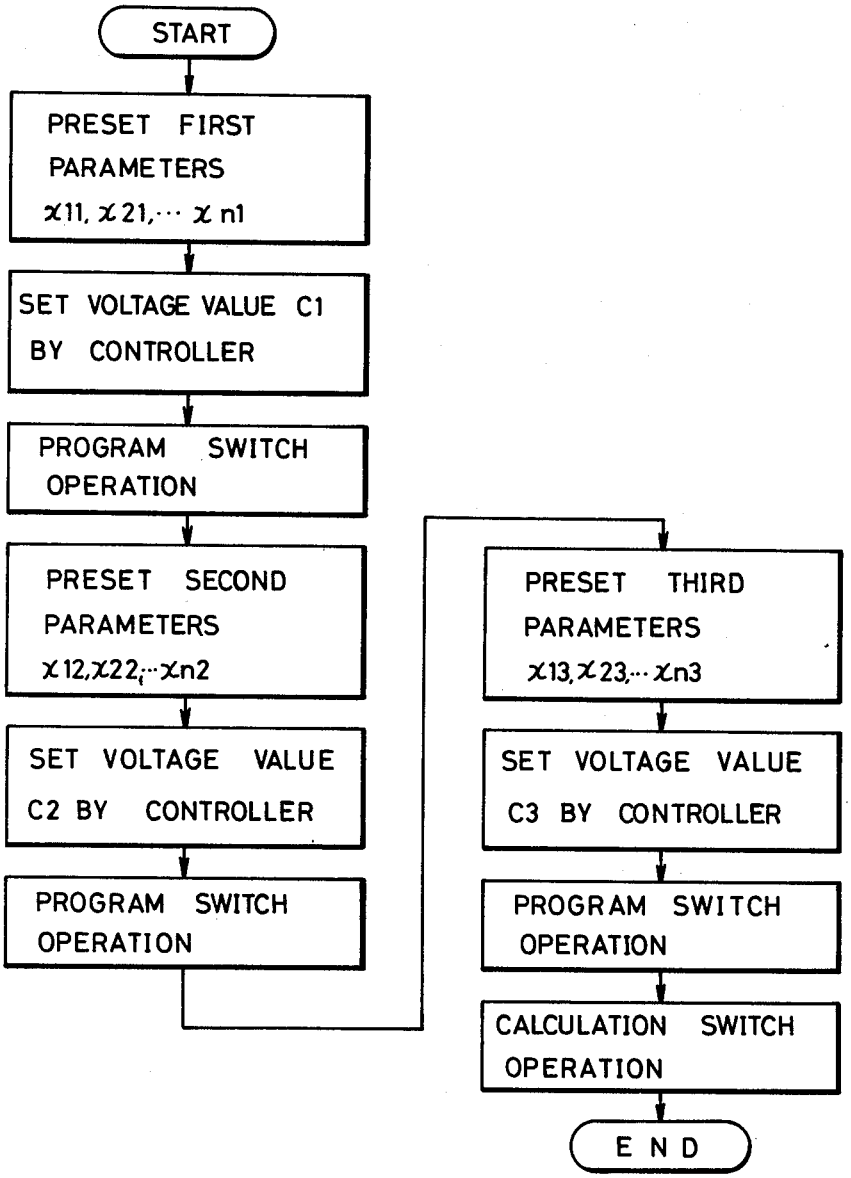
Figure 12:
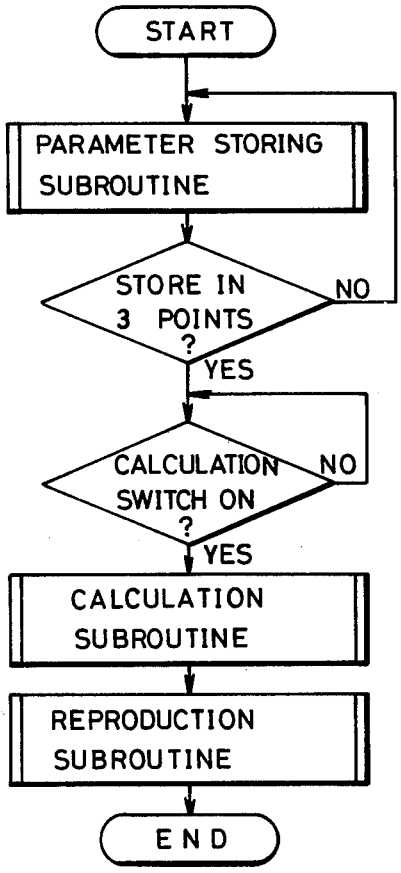
Figure 13:
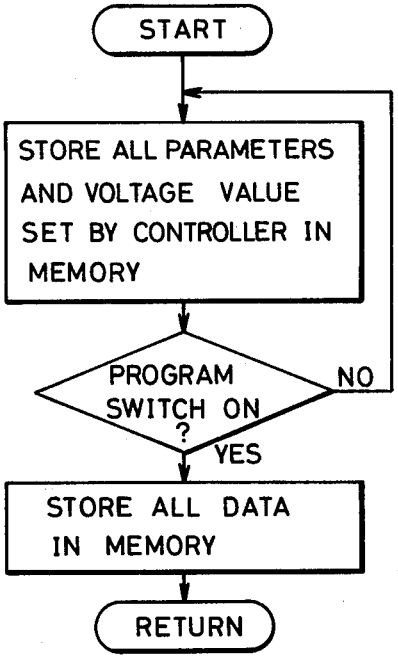
Figure 14:
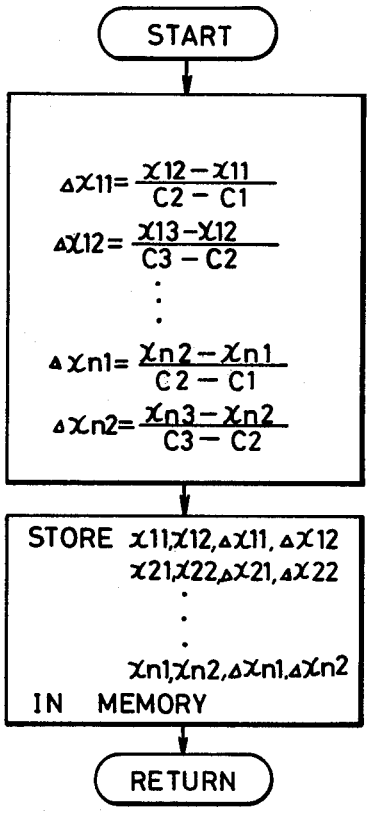
Figure 16:
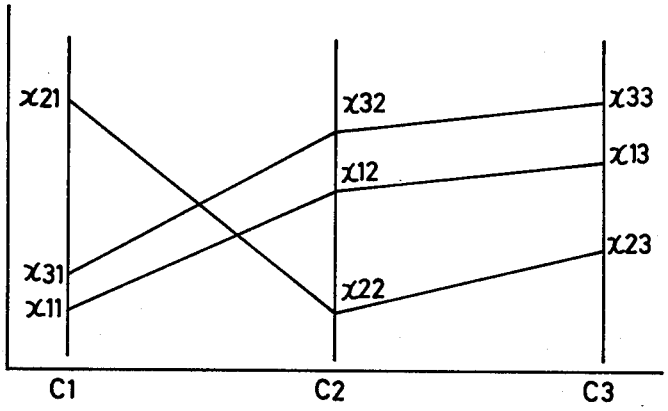
FIG. 16 is a graph depicting an evaluation of the parameters for explaining an interpolation value of the parameters.
Figure 15:
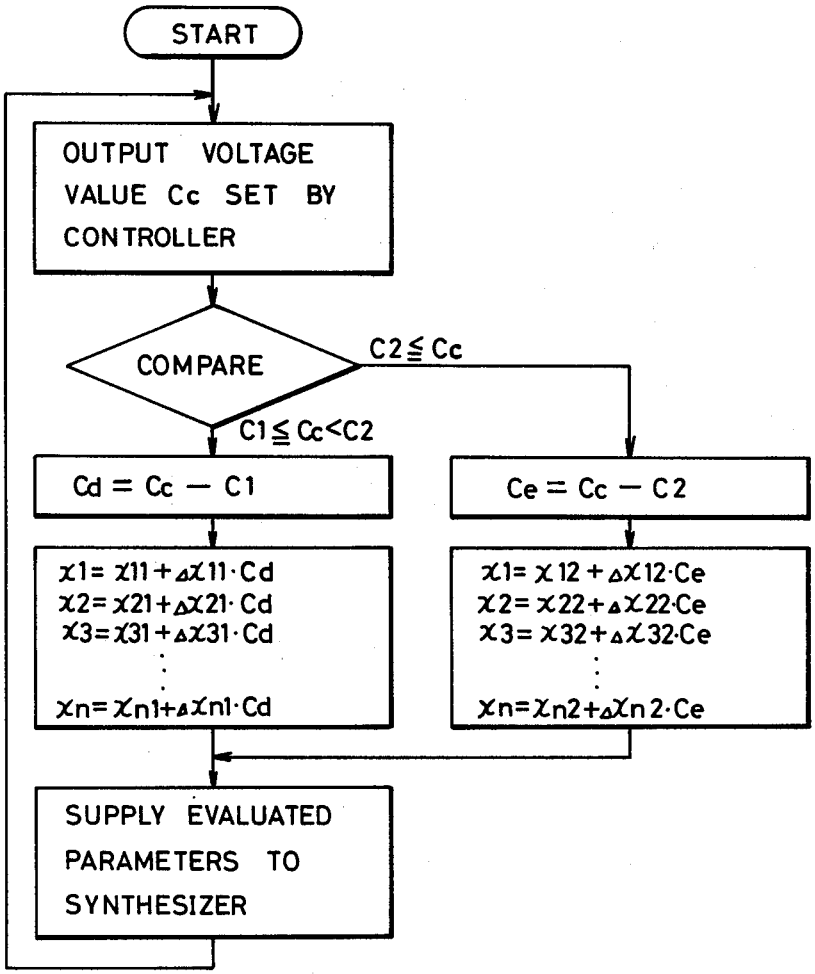

The second embodiment shown in FIGS. 8 to 10 is adapted to produce a musical tone signal by storing sound aspects of three kinds by operating the parameter setting variable resistors 11 to 1*n* and by operating the parameters for interpolation therebetween. The structure shown in FIG. 8 is substantially the same as that shown in FIG. 1 except for the following. More specifically, the controller 10 is implemented by a so called modulation lever for setting a voltage value by rotating a knob, as shown in FIGS. 9A and 9B. It is pointed out that in FIG. 8 the second program switch 62 and the store switch 64 shown in FIG. 1 have been omitted from the illustration. In setting the three kinds of sound aspects, x11 is set by operating the knob of the parameter setting variable resistor 11 as shown in FIG. 10 and the parameter x21 is set by operating the knob of the parameter setting variable resistor 12 and thereafter the respective parameter setting variable resistors 13 to 1*n* are operated in the same manner, for setting the desired parameters in succession. Likewise the parameters x12 to xn2 and the parameters x13 to xn3 are set, thereby to set the three kinds of sound aspects.

Now referring to FIGS. 8 to 16, a specific operation of the second embodiment of the present invention shown in FIG. 8 will be described. First, in order to set a first sound aspect, the knobs of the parameter setting variable resistors 11 to 1*n* shown in FIG. 10 are operated, whereby the first parameters x11 to xn1 are set. Then the controller 10 is operated so that the voltage value of C1 may be outputted, whereby the digital values of the voltage value corresponding to the respective parameters x11 to xn1 set by the parameter setting variable resistors 11 to 1*n*, respectively, and the voltage value C1 set by the controller 10 are supplied to the central processing unit 40. The central processing unit 40 proceeds to the parameter storing subroutine shown in FIG. 13, whereby the data based on the voltage value of the parameters x11 to xn1 are set and the voltage value C1 set by the controller 10 is temporarily stored in the memory 50 and at the same time the value C1 is digital/analog converted by the digital/analog converter 80 and the converted output is supplied to the holding circuits 101 to 10*n*. Then the central processing unit 40 determines whether the program switch 61 has been operated and if the same determines that the program switch 61 has been operated, then the same stores the above described data in the storing region 51 of the memory 50. The storing region 51 includes a storing region for storing a voltage value set by the controller 10. The central processing unit 40 returns to the main routine after it has stored the parameters x11 to xn1 and the voltage value C1 in the memory 50.

Then the parameters x12 to xn2 of the second sound aspects are set by operating the parameter setting variable resistors 11 to 1*n* and the voltage value C2 is set by the controller 10, whereupon the program switch 61 is operated. Then, in the same manner as described above, the voltage value corresponding to the parameters x12 to xn2 and the voltage value C2 set by the controller 10 are stored in the storing region 52 of the memory. Likewise, the parameters x13 to xn3 of the third sound aspect are set by the parameter setting variable resistors 11 to 1*n*, whereupon the voltage value C3 is set by the controller 10. When the program switch 61 is then operated, the parameters x13 to xn3 and the voltage value C3 are stored in the memory 50. Then the calculation switch 63 is operated, whereby the program proceeds to the calculation subroutine shown in FIG. 14.

In the calculation subroutine, the ratios of the voltage value set by the controller 10 and the respective parameters are evaluated in the same manner as described above in conjunction with FIG. 5; however, since the three voltage values C1, C2 and C3 have been set by the controller 10 in the embodiment shown, the ratios of the respective voltage values and the parameters are evaluated. More specifically, the ratio Δx11 of the difference between the voltage values C1 and C2 and the difference between the parameters x11 and x12, and the ratio Δx12 of the difference between the voltage values C2 and C3 and the difference between the parameters x12 and x13 are evaluated. Likewise the ratios of the respective parameters are evaluated in succession. The respective parameters x11 to xn1 and x12 to xn2 and the evaluated ratios Δx11 to Δxn1 and Δx12 to Δx2 are stored in the memory 50. When the central processing unit 40 completes the processing of the calculation subroutine, then the same proceeds to the reproduction subroutine shown in FIG. 15.

First the controller 10 is operated to set Cc between the voltage values C1 and C2, for example. The voltage value Cc is applied to the central processing unit 40 through the multiplexer 20 and the analog/digital converter 30. Accordingly, the central processing unit 40 determines whether the set voltage value Cc is a value between C1 and C2. If and when the same determines that the voltage value Cc is a value between C1 and C2, then the same evaluates the difference Cd between the voltage values Cc and C1. Then the evaluated value Cd is multiplied by the ratio Δx11 stored in the memory 50 and the product thus obtained is added to the parameter x11, whereby the interpolated value x1 of the parameter is evaluated. Likewise the interpolated values x2 to xn of the parameters are evaluated in succession. The interpolated values x1 to xn of the parameters thus obtained as a result of evaluation are applied through the digital-/analog converter 80, demultiplexer 90 and the holding circuits 101 to 1O*n* to the synthesizer 110. As a result, a performance tone based on the parameters interpolated between the parameters responding to the sound aspects of the two kinds set by the controller 10 can be produced by the synthesizer 110. If the voltage value Cc set by the controller 10 is larger than the voltage value C2, the central processing unit 40 evaluates the voltage value Ce by subtracting the voltage value C2 from Cc. Then the ratio Δx12 is multiplied by Ce and the product thus obtained is added to the parameter x12 of the second kind, whereby the interpolated parameter x1 is evaluated. Likewise the parameters x2 to xn are evaluated and the evaluation results are supplied through the digital/analog converter 80, the demultiplexer 90 and the holding circuits 101 to 1O*n* to the synthesizer 110. Accordingly, a musical tone corresponding to parameters x1 to xn operated between the parameters corresponding to C2 and C3 set by the controller 10 can be produced by the synthesizer 110.

The above described embodiment is adapted such that the voltage values C1 to C3 are set by operating the modulation lever. However, the embodiment may be such that a so called sensor is employed in which a depression force is detected to produce a voltage associated with the depression force produced without using the modulation lever.

In executing the above described reproduction subroutine, it may be adapted such that, in place of operating the modulation lever, an envelope signal voltage generating apparatus for generating an envelope signal is provided and an envelope signal voltage thus obtained is applied through the multiplexer 20 and the analog/digital converter 30 to the central processing unit 40. By doing so, it is possible to interpolate between the parameters corresponding to the voltage values set by the modulation lever in association with an instantaneous value of the envelope signal voltage and to produce by the sound aspect generating apparatus, a musical tone signal corresponding to the thus interpolated parameters. Furthermore, it is possible to produce a musical tone signal corresponding to the parameters changing as a function of time, by simply selecting arbitrarily the waveform of the envelope signal voltage and without any manual operation of the modulation lever.

Furthermore, it may be adapted such that, in place of setting a voltage value by the modulation lever, the output voltage from the function generator is supplied. More specifically, the function generator for generating an arbitrary voltage signal upon being triggered when a keyboard, not shown but included in the synthesizer, is operated, is constructed so that the parameters of the tone color as set may be interpolated based on the output voltage from the function generator. By doing so, a musical tone signal having an interpolated tone color may be produced based on the output voltage of the function generator. However, in such a case, it is necessary to omit an attack time, a decay time, a sustain level and a release time from the parameters for setting the sound aspects.

Figure 17:
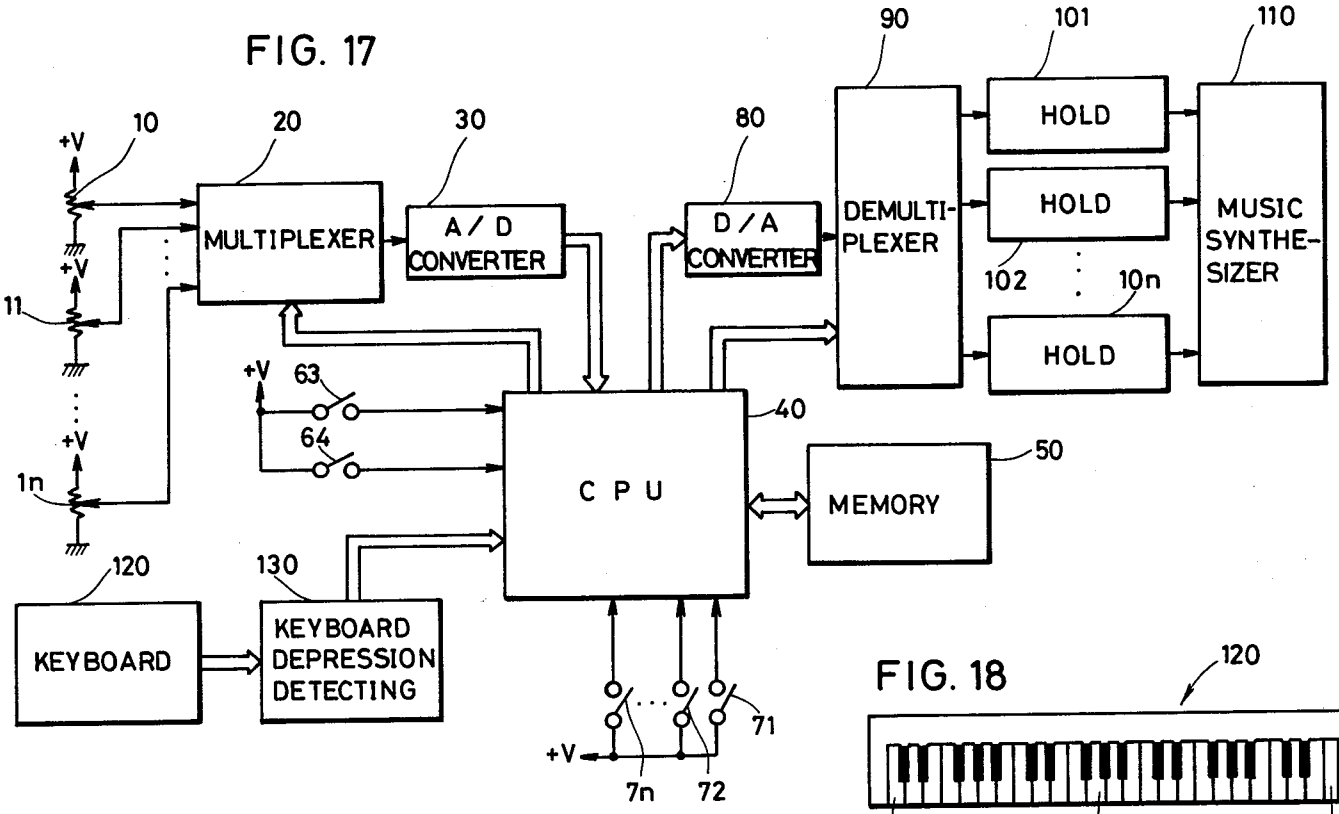
FIG. 17 is a block diagram showing a third embodiment of the present invention.
Figure 18:
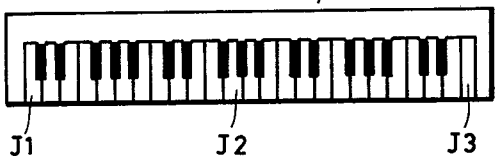
FIG. 18 is a top view of a keyboard shown in FIG. 17.
Figure 19:
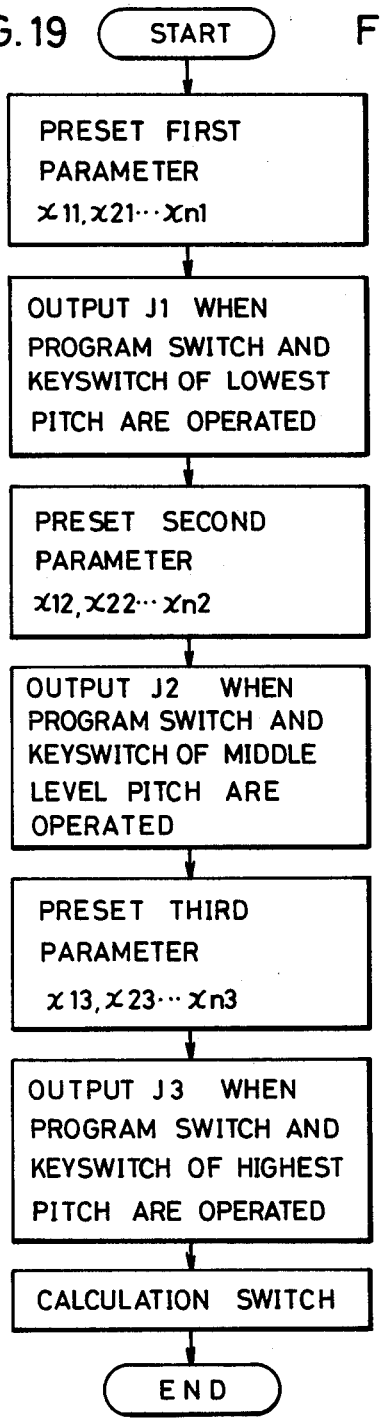
Figure 20:
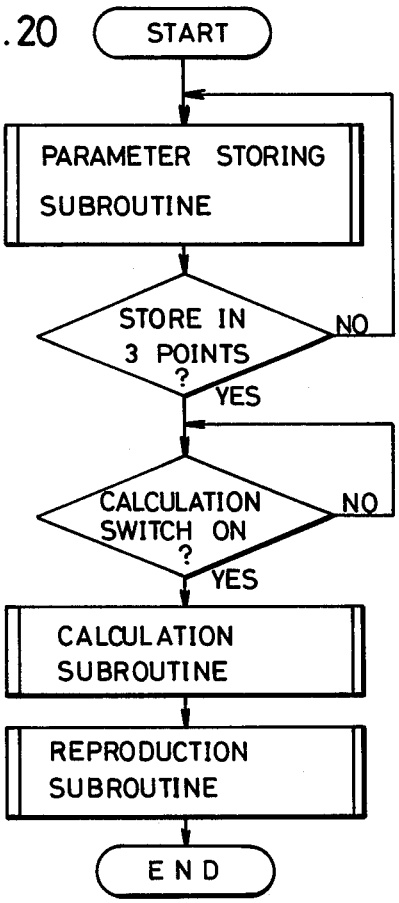
Figure 21:
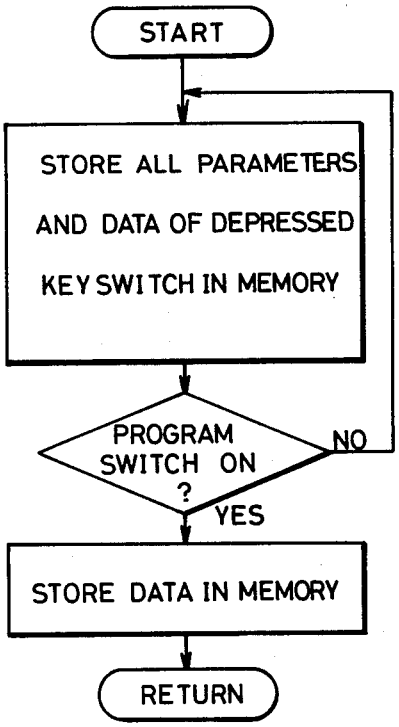
Figure 22:
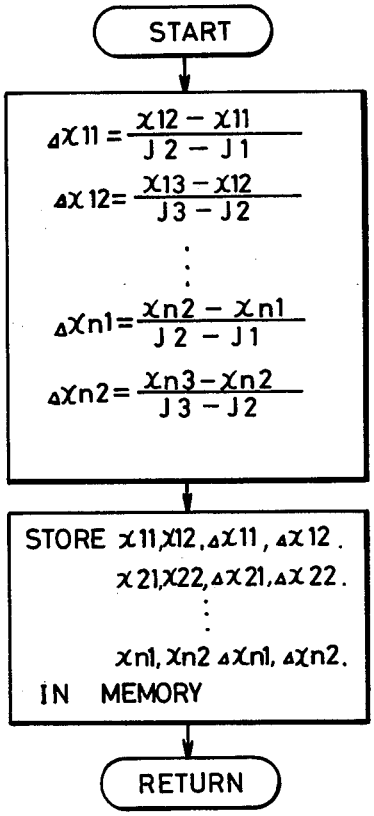
Figure 23:
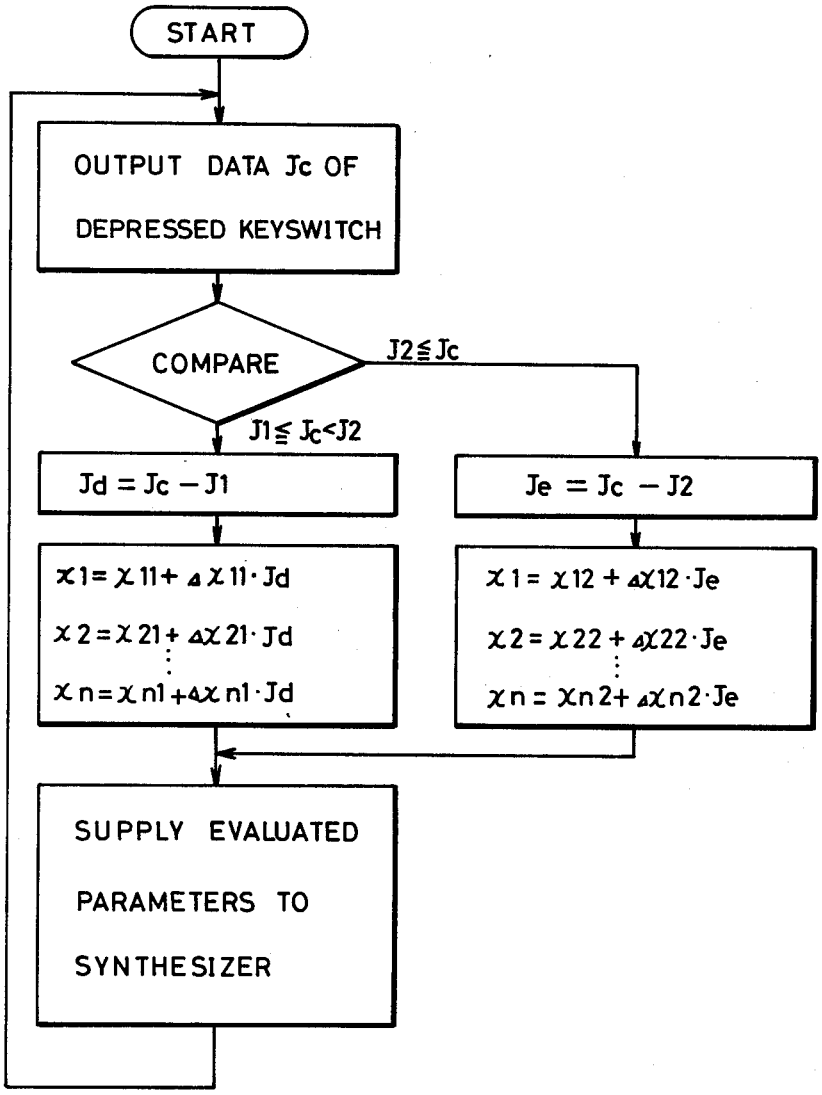

FIG. 17 is a block diagram showing a third embodiment of the present invention, and FIG. 18 is a plan view of a keyboard shown in FIG. 17. The embodiment is adapted such that three pitches of the sound aspects are designated by the keyboard 120 serving as the sound aspect designating means so that a musical tone may be produced which changes in accordance with a change of the pitch caused by interpolation therebetween. To that end, the keyboard 120 and the keyboard depression detecting circuit 130 are provided in place of the controller 10 shown in FIG. 8. As shown in FIG. 18, the keyboard 120 may be constructed in the same manner as a keyboard of a conventional piano or organ. The keyboard depression detecting circuit 130 is provided for detecting whether each of the keys of the keyboard 120 is depressed or not.

Now referring to FIGS. 17 to 23, a specific operation of the third embodiment of the present invention will be described. First the program proceeds to the parameter storing subroutine shown in FIG. 21. Then the parameter setting variable resistors 11 to 1*n* are each set, so that the first parameters x11 to xn1 are set. Then the program switch 63 and a keyswitch of the lowest pitch included in the keyboard 120 are simultaneously operated. Then the keyboard depression detecting circuit 130 detects the depression of the keyswitch of the lowest tone of the keyboard 120 to provide a detected signal to the central processing unit 40.

On the other hand, the parameters x11 to xn1 are supplied through the multiplexer 20 to the analog/digital converter 30, whereby these parameters are converted by the analog/digital converter 30 to a digital value, which is temporarily stored in the memory together with the data J1 based on the keyswitch of the lowest tone of the keyboard 120. Then it is determined that the program switch 63 is operated, whereupon the above described parameters x11 to xn1 and the data J1 of the keyswitch of the lowest pitch are stored in the storing region 51 of the memory 50, whereupon the program returns to the main routine.

Then the parameter setting variable resistors 11 to 1*n* are operated so that the second parameters x12 to xn2 are set, whereupon the program switch 63 is operated and at the same time the keyswitch of a middle level pitch of the keyboard 120 is operated. Then, in the same manner as described previously, the parameters x12 to xn2 set by the parameter storing subroutine and the data J2 of the keyswitch are stored in the storing region 52 of the memory 50. Furthermore, the parameter setting variable resistors 11 to 1*n* are operated, so that the third parameters x13 to xn3 are set, whereupon the program switch 63 is operated and at the same time the keyswitch of the highest pitch of the keyboard 120 is operated. Then, in the same manner as described above, the parameters x13 to xn3 and the data J3 of the keyswitch of the highest pitch are stored in the storing region 53 of the memory 50. Thereafter the calculation switch 64 is operated, whereby the program proceeds to the calculation subroutine shown in FIG. 20. In the calculation subroutine, the ratios Δx11 to Δxn1 and Δx12 to Δxn2 are each evaluated in the same manner as described previously in conjunction with FIG. 13. However, the ratios in such case represent the differences between the data J1 based on the keyswitch of the lowest level pitch and the data J2 of the keyswitch of the middle level pitch, and the difference between the data J2 and the data J3 based on the keyswitch of the highest level pitch. Then the respective parameters x11 to xn1, x12 to xn2 and the ratios Δx11 to Δxn1 and Δx12 to Δxn2 are stored in the memory 50. Thereafter the central processing unit 40 proceeds to the reproduction subroutine shown in FIG. 21.

In producing a tone of a desired pitch based on the data of the ratio stored in the memory 50, any of the keyswitches included in the keyboard 120 is operated. The data Jc of the keyswitch as operated is applied to the central processing unit 40, whereupon the central processing unit 40 compares the inputted data Jc and the data J1 of the keyswitch of the lowest level pitch tone and the data J2 of the keyswitch of the middle level pitch. If and when Jc becomes a value between J1 and J2, Jd is evaluated by subtracting the data J1 of the keyswitch of the lowest level pitch from the data Jc of the keyswitch as operated. Then the evaluated Jd is multiplied by the ratio Δx11, and x11 of the first parameter is added to the same, thereby to evaluate the interpolating data x1. Thereafter the interpolating data x2 to xn is evaluated in the same manner. The parameters x1 to xn of the interpolating data thus evaluated are supplied through the digital/analog converter 80, the demultiplexer 90 and the holding circuits 101 to 10*n* to the synthesizer 110.

If and when any key between the keyswitch of the middle level pitch and the keyswitch of the highest level pitch of the keyboard 120 is operated, it is determined that the data Jc of the operated keyswitch is larger than the data J2 of the keyswitch of the middle level pitch, thereby to evaluate the difference Je therebetween. Then the evaluated Je is multiplied by the ratio Δx12 and the second parameter x12 is added thereto, thereby to evaluate the parameter x1 by way of the interpolating data. Likewise, x2 to xn are evaluated and a sound based on the evaluated parameters is produced by the synthesizer 110.

The above described embodiment was described in conjunction with the interpolation of the parameters in the case where the features of the tone colors of the musical instruments are changed in accordance with the pitch of the keyboard. If it is desired to implement such a musical instrument wherein a tone color changes depending on the intensity of striking of a key of a piano or the like, it is possible to produce a performing sound by interpolation of such parameters depending on the intensity of striking of a key and the pitch of the depressed key. To that end, it is determined by the keyboard depression detecting circuit 130 which key of the keyboard 120 was depressed and also a depressing force of each key is detected by the keyboard depression detecting circuit 130. On the other hand, at least four kinds of parameters of the strongest and the weakest striking force of the key in the lowest pitch and the strongest and the weakest striking force of the key in the highest pitch are set thereby. If and when in the parameters corresponding to the pitch of the depressed key and the intensity of striking of the key are evaluated by interpolating the above described set parameters, a performing tone of a musical tone having the features corresponding to the intensity of the striking of the key and the pitch thereof may be obtained. Although the above described embodiment was described with reference to a case where the respective parameters of the two kinds of the sound aspects are connected by a straight line, whereupon an arbitrary point therebetween is interpolated, alternatively it may be adapted such that the respective parameters of the two kinds of the sound aspects are connected by a curve, whereupon an arbitrary point therebetween is interpolated.

Furthermore, the present invention may be practiced by way of a combination of the above described three embodiments.

Although the above embodiments were all described with reference to a case where a sound aspect is produced for supplying a musical tone signal to an analog synthesizer, the present invention may be practiced so that a sound aspect is supplied to a digital synthesizer. In such a case, the parameters read from the memory may be supplied as such without the same being converted to an analog value.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A sound aspect generating apparatus for an electronic musical instrument, wherein a sound aspect is composed of a plurality of parameters and a musical tone signal is produced based on such composed sound aspect, comprising: parameter setting means for setting a plurality of parameters each constituting at least two kinds of sound aspects, sound aspect designating means for designating at least two kinds of sound aspects represented by said plurality of parameters set by said parameter setting means, arbitrary sound aspect designating means for designating an arbitrary point between said at least two kinds of sound aspects designated by said sound aspect designating means, derivative evaluating means for evaluating a derivative of each of said parameters between said at least two kinds of sound aspects designated by said sound aspect designating means, parameter evaluating means for evaluating a parameter for the interpolation of said arbitrary point designated by said arbitrary sound aspect designating means based on said derivative evaluated by said derivative evaluating means, and sound aspect providing means for providing a sound aspect based on the parameters evaluated by said parameter evaluating means.

2. The sound aspect generating apparatus of claim 1, wherein said parameter evaluating means comprises difference evaluating means for evaluating a difference between said arbitrary point designated by said arbitrary sound aspect designating means and at any one of said at least two kinds of said sound aspects designated by said sound aspect designating means, multiplication means for multiplying said difference evaluated by said difference evaluating means and said derivative evaluated by said derivative evaluating means, and adding means for adding the product obtained by said multiplying to any one of said parameters of said at least two kinds of sound aspects designated.

3. The sound aspect generating apparatus of claim 1, wherein said parameter setting means comprises parameter storing means for storing in advance said plurality of parameters.

4. The sound aspect generating apparatus of claim 3, wherein said parameter setting means comprises parameter input means for storing said plurality of parameters in said parameter storing means.

5. The sound aspect generating apparatus of claim 4, wherein said parameter input means comprises a plurality of variable resistors for providing said plurality of parameters by way of respective voltage values, a multiplexer for providing in a time sharing fashion said respective voltage values from said plurality of variable resistors, analog-to-digital converter means for converting the output from said multiplexer to a digital value, and loading means for loading the output from said analog-to-digital converter means into said parameter storing means.

6. The sound aspect generating apparatus of claim 1, wherein said arbitrary sound aspect designating means comprises a keyboard.

* * * * *